US005258049A

United States Patent [19]

Liotta, Jr. et al.

[11] Patent Number: 5,258,049

[45] Date of Patent: Nov. 2, 1993

[54] DIESEL FUEL COMPOSITION

[75] Inventors: Frank J. Liotta, Jr., Collegeville; John A. Sofranko; Lawrence J. Karas, both of West Chester, all of Pa.

[73] Assignee: ARCO Chemical Technology, L.P., Wilmington, Del.

[21] Appl. No.: 18,954

[22] Filed: Feb. 17, 1993

[51] Int. Cl.[5] ..... C10L 9/10

[52] U.S. Cl. ..... 44/324

[58] Field of Search ..... 44/413, 324

[56] References Cited

U.S. PATENT DOCUMENTS

| | | | |
|---|---|---|---|
| 2,905,540 | 9/1959 | von Schickh | 44/324 |
| 4,405,333 | 9/1983 | Seemuth | 44/324 |
| 4,405,334 | 9/1983 | Seemuth | 44/324 |
| 4,406,665 | 9/1983 | Filbey | 44/324 |
| 4,421,522 | 12/1983 | Seemuth | 44/324 |
| 4,457,763 | 7/1984 | Seemuth | 44/324 |
| 4,473,378 | 9/1984 | Hanlon et al. | 44/324 |
| 4,536,190 | 8/1985 | Seemuth | 44/324 |
| 4,705,534 | 11/1987 | Yan | 44/325 |
| 4,723,963 | 2/1988 | Taylor | 44/436 |

OTHER PUBLICATIONS

A. McKillop and M.E. Ford, Mercury-Assisted Solvolyses of Alkyl Halides, 1974, pp. 2467-2475.

"Nitration, Methods and Mechanisms", authored by George A. Olah, Rupudaman Malhotra and Subhash C. Narang, VCH Publishers, N.Y., pp. 27-0275 (1989).

"Hydrolytic Decomposition of Esters of Nitric Acid", (Part V), authored by John W. Baker and T. G. Heggs, *J. Chem. Soc.*, 1955, pp. 616-630.

"Stereochemistry and Mechanism in Reactions of Silver Salts with Alkyl Halides. The Reaction of Silver Nitrate with Alkyl Halides." authored by Nathan Kornblum and Donald E. Hardies, *J. Amer. Chem. Soc.*, 88, pp. 1707-1711 (1966).

"Synthetic Methods and Reactions" authored by George A. Olah, Subhash C. Narang, Ronald L. Pearson and Chriss A. Cupas, *Syn*, 1978, pp. 452-453.

*Primary Examiner*—Prince Willis, Jr.
*Assistant Examiner*—Edna Wong
*Attorney, Agent, or Firm*—William C. Long

[57] ABSTRACT

The invention relates to diesel fuel containing the nitric acid ester of 1-phenyl ethanol as cetane improver.

3 Claims, No Drawings

DIESEL FUEL COMPOSITION

BACKGROUND OF THE INVENTION

1. Field of the Invention

The present invention relates to improvement in the cetane rating of diesel fuel by the addition of a small but effective amount of the nitric acid ester of 1-phenyl ethanol herein called methyl benzyl alcohol nitrate (MBAN).

2. Description of the Prior Art

Diesel engines operate by compression ignition. They have compression ratios in the range of 14:1 to 17:1 or higher and for this reason obtain more useful work from a given amount of fuel compared to an Otto cycle engine. Historically, diesel engines have been operated on a petroleum-derived liquid hydrocarbon fuel boiling in the range of about 300°–750° F.

One major factor in diesel fuel quality is cetane number. Cetane number is related to ignition delay after the fuel is injected into the combustion chamber. If ignition delays too long, the amount of fuel in the chamber increases and upon ignition results in a rough running engine and increased smoke. A short ignition delay results in smooth engine operation and decreases smoke. Commercial petroleum diesel fuels generally have a cetane number of about 40–55.

Through the years, many types of additives have been used to raise the cetane number of diesel fuel. These include peroxides, nitrites, nitrates, nitrosocarbonates and the like. Alkyl nitrates such as amyl nitrate, hexyl nitrate and mixed octyl nitrates have been used commercially with good results.

Two main factors determine the commercial potential of a compound for use as a cetane improvement additive. These are the ease of handling the material and the cost/performance ratio relative to other suitable materials. Many nitrate esters have been described that are more effective cetane improvement additives than both the nitrate ester described in this invention and the commonly used commercial material, 2-ethylhexyl nitrate. However, most of these materials are too unstable to be of use in typical commercial applications. U.S. Pat. Nos. 4,473,378 and 4,536,190 teach that 2-methyl-2-nitropropanol nitrate requires stabilization do to its shock-sensitive nature. The shock sensitivity of this compound is typical of dinitrates from glycols. This shock sensitivity makes this compound unsuitable for commercial use. U.S. Pat. No. 4,705,534 teaches that the dinitrates prepared from a series of ethyl glycols are also unstable and require stabilization. While various stabilization techniques can be used to stabilize these nitrates, they are still considered too unstable for commercial use. Mononitrates are typically more stable than the polynitrates, therefore are more suitable for commercial applications.

Numerous mononitrates have been reported that produce a larger increase in cetane number than the nitrate ester described in this invention. However, these compounds are prepared from alcohols more costly than a-phenylethyl alcohol, which is used to prepare the nitrate of this invention. Examples of such compounds are 4-morpholine ethanol nitrate (U.S. Pat. No. 4,421,552), tetrahydro-2H-pyran-3-ol nitrate (U.S. Pat. No. 4,405,333), 1-methyl-3-piperidinol nitrate (U.S. Pat. No. 4,405,334), 1,3-dioxolane-4-methanol nitrate (U.S. Pat. No. 4,457,763) and tetrahydrofuranol nitrate (U.S. Pat. No. 4,406,665). Due to its lower cost, the nitrate ester described in this invention has a better performance to cost ratio than the nitrate esters described here.

The performance of mononitrate esters prepared from simple alkanols is similar to the performance of the nitrate ester described in this invention. The increase in cetane number obtained by adding 1.5% of some of these nitrate esters to a base diesel fuel are listed below:

| | |
|---|---|
| Butyl Nitrate | 16.8 |
| Isopropyl Nitrate | 17.9 |
| Primary Amyl Nitrate | 13.0 |
| Secondary Hexyl Nitrate | 17.6 |
| n-Heptyl Nitrate | 14.8 |
| n-Nonyl Nitrate | 13.3 |

U.S. Pat. No. 4,723,963 describes improving the cetane rating of diesel fuels by adding to the fuels alkyl aromatics having an oxygenate functionality in the benzylic position. We are not aware of prior art showing the use of nitrate esters of such materials in diesel fuel.

The preparation of methyl benzyl alcohol nitrate is known. One such preparation involves the reaction of the methyl benzyl halide with silver nitrate. See Olah, G. A.; Malhotra, R; Narang, S. C.; "Nitration, Methods and Mechanisms", VCH Publishers, New York, p. 270 (1989), Heggs, B; *J. Chem. Soc.*, 1955, 616, and Komblum, N.; Hardies, D. E.; *J. Amer. Chem. Soc.*, 88, 1707 (1966).

The nitric acid ester can also be produced from the corresponding alcohol, 1-phenyl ethanol (methyl benzyl alcohol) using either N-nitropyridinium tetrafluoroborate or N-nitrocollidium tetrafluoroborate. See Olah, G. A.; Malhotra, R.; Narang, S. C.; "Nitration, Methods and Mechanisms", VCH Publishers, New York, p. 271 (1989), and Olah, G.; Narang, S. C.; Pearson, R. L.; Cupas, C. A.; Syn, 1978, 452.

Commercial processes for the production of nitric acid esters from corresponding alcohols typically use a mixture of nitric acid and sulfuric acid.

BRIEF DESCRIPTION OF THE INVENTION

In accordance with the invention, improved cetane ratings are achieved with diesel fuel having incorporated therein an effective amount of the nitrate ester of 1-phenyl ethanol having the formula:

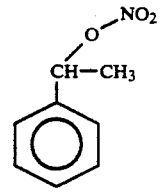

DETAILED DESCRIPTION

The hydrocarbon based diesel fuels utilized in the practice of this invention are comprised in general of mixtures of hydrocarbons which fall within the diesel fuel boiling range, typically about 160° to about 370° C. The fuels are often referred to as middle distillate fuels since they comprise the fractions which distill after gasoline. The diesel fuels of the invention have a low sulfur content, i.e. not more than 500 ppm by weight, preferably not more than 100 ppm and preferably not more than 60 ppm sulfur by weight. Aromatic content is in the range of 10–50% by volume, preferably 20–35% by volume.

The MBAN is incorporated in the diesel fuel in a small but effective amount to improve the cetane rating thereof. The diesel fuel formulations of the present invention comprise at least 85% by volume diesel fuel hydrocarbons and 0.01 to about 3 volume % of MBAN, preferably about 0.1 to about 2 volume % MBAN.

Conventional additives and blending agents for diesel fuel may be present in the fuel compositions of this invention in addition. For example, the fuels of this invention may contain conventional quantities of conventional cetane improvers, friction modifiers, detergents, antioxidants, heat stabilizers and the like. The following example illustrates the invention.

EXAMPLE a) Preparation of nitric acid (1-phenyl ethanol ester)

a-Phenylethyl bromide, 18.5 g, is added dropwise to a suspension of silver nitrate, 25.6 g, in 150 ml of diethyl ether. The resulting suspension was allowed to stir for approximately sixteen hours at room temperature under a nitrogen atmosphere. The solution was then filtered and twice washed with 50 ml of diethyl ether. The solution was concentrated under vacuum. The resultant liquid was then carefully distilled under vacuum, 65° C. at 2 torr. The pure product gave the following $C^{13}$ NMR spectra in $CDCl_3$: 20.7, 82.5, 126.7, 129.2, 129.4, 139.2.

b) Cetane Improvement Tests

In order to determine the effectiveness of nitric acid (1-phenyl ethanol ester) as a cetane improvement additive, the nitrate ester was added in varying proportions to a base diesel fuel having a cetane number of 43, an aromatic content of 31% and a sulfur level of 370 ppm. In addition to the blends containing the nitrate ester of this invention, blends were prepared using the same concentrations of the commercial cetane improver, 2-ethylhexyl nitrate. The samples of the diesel fuel compositions containing the nitrate ester of this invention or the commercial material were tested for cetane number under the standard test as outlined in ASTM D613.

This test compares the ignition quality of an unknown fuel to that of reference fuels under the same operating conditions. The test is conducted using a single cylinder test engine with a variable compression ratio. The compression is varied to obtain the same time delay between injection and ignition for both the test fuel and the reference fuel. The cetane number rating of the test fuel is calculated by comparing the compression ratios of the test and reference fuels.

The following results were obtained by this method:

| Add. Level | Cetane Number | | Cetane Net Change | |
|---|---|---|---|---|
| (vol. %) | EHN | MBAN | EHN | MBAN |
| 0.0 | 42.2 | 42.2 | — | — |
| 0.5 | 52.0 | 50.4 | +9.8 | +8.2 |
| 1.0 | 58.3 | 52.4 | +16.1 | +10.0 |
| 1.5 | 63.4 | 57.4 | +21.2 | +15.2 |

While the nitrate ester of this invention is slightly less effective than the commercial material, it has a cost advantage over the currently commercial material. The cost advantage is due to the comparably lower cost of starting alcohol, 1-phenyl ethanol. The 1-phenyl ethanol is a major product produced during the commercial production of propylene oxide from the reaction of ethyl benzene hydroperoxide with propylene.

I claim:

1. Diesel fuel composition comprising hydrocarbon boiling in the diesel fuel range and a cetane improving amount of the nitric acid ester of 1-phenyl ethanol

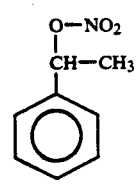

2. The fuel composition of claim 1 wherein the fuel contains 0.01 to 3 vol.% of the nitric acid ester of 1-phenyl ethanol.

3. The fuel composition of claim 1 wherein the sulfur content is not more than 500 ppm by weight.

* * * * *